US006056905A

United States Patent [19]

Akkermans et al.

[11] Patent Number: 6,056,905

[45] Date of Patent: May 2, 2000

[54] PRODUCTION OF DETERGENT GRANULATES

[75] Inventors: Johannes Hendrikus Akkermans, Vlaardingen, Netherlands; Michael Frederick Edwards, Bebington, United Kingdom; Andreas Theodorus Groot, Vlaardingen, Netherlands; Cornelis Paulus Montanus, Vlaardingen, Netherlands; Roland Wilhelmus Pomeren, Vlaardingen, Netherlands; Korkut Ahmet Yuregir, Bebington, United Kingdom

[73] Assignee: Lever Brothers Company Division of Conopco, Inc., New York, N.Y.

[21] Appl. No.: 09/094,822

[22] Filed: Jun. 15, 1998

[30] Foreign Application Priority Data

Jun. 16, 1997 [GB] United Kingdom ..... 9712580

[51] Int. Cl.[7] ..... C11D 11/00

[52] U.S. Cl. ..... 264/117; 23/313 FB; 510/444

[58] Field of Search ..... 264/117; 510/444; 23/313 FB

[56] References Cited

U.S. PATENT DOCUMENTS

| | | | |
|---|---|---|---|
| 4,153,625 | 5/1979 | Barton et al. | 260/457 |
| 4,219,589 | 8/1980 | Niks et al. | 427/213 |
| 4,619,843 | 10/1986 | Mutsers | 427/213 |
| 4,701,353 | 10/1987 | Mutsers et al. | 427/213 |
| 4,734,224 | 3/1988 | Barrett et al. | 252/558 |
| 5,516,447 | 5/1996 | Bauer et al. | 252/89.1 |
| 5,629,275 | 5/1997 | Bauer et al. | 510/108 |
| 5,739,097 | 4/1998 | Bauer et al. | 510/446 |

FOREIGN PATENT DOCUMENTS

| | | |
|---|---|---|
| 304 192 | 2/1989 | European Pat. Off. . |
| 164 514 | 6/1989 | European Pat. Off. . |
| 345090 | 12/1989 | European Pat. Off. . |
| 353 976 | 2/1990 | European Pat. Off. . |
| 353976 | 2/1990 | European Pat. Off. . |
| 367 399 | 5/1990 | European Pat. Off. . |
| 384 070 | 8/1990 | European Pat. Off. . |
| 390 251 | 10/1990 | European Pat. Off. . |
| 420 317 | 4/1991 | European Pat. Off. . |
| 555 622 | 8/1993 | European Pat. Off. . |
| 140 987 | 4/1980 | Germany . |
| 140 987 | 9/1980 | Germany . |
| 255 833 | 4/1988 | Germany . |
| 42 32 874 | 3/1994 | Germany . |
| 43 04 015 | 8/1994 | Germany . |
| 43 04 062 | 8/1994 | Germany . |
| 44 43 644 | 6/1996 | Germany . |
| 166 307 | 4/1990 | India . |
| 88903 | 6/1986 | Romania . |
| 707994 | 4/1954 | United Kingdom . |
| 748780 | 5/1956 | United Kingdom . |
| 953655 | 3/1964 | United Kingdom . |
| 1 118 908 | 7/1968 | United Kingdom . |
| 1 341 557 | 12/1973 | United Kingdom . |
| 1 437 950 | 6/1976 | United Kingdom . |
| 1 470 250 | 4/1977 | United Kingdom . |
| 1 473 201 | 5/1977 | United Kingdom . |
| 1 473 202 | 5/1977 | United Kingdom . |
| 2 209 172 | 5/1989 | United Kingdom . |
| 93/04154 | 3/1993 | WIPO . |
| 93/19151 | 9/1993 | WIPO . |
| 93/23520 | 11/1993 | WIPO . |
| 94/03267 | 2/1994 | WIPO . |
| 94/24260 | 10/1994 | WIPO . |
| 95/00630 | 1/1995 | WIPO . |
| 95/25158 | 9/1995 | WIPO . |
| 96/03485 | 2/1996 | WIPO . |
| 96/04359 | 2/1996 | WIPO . |
| 97/22685 | 6/1997 | WIPO . |
| 97/28246 | 8/1997 | WIPO . |
| 98/14549 | 4/1998 | WIPO . |
| 98/14550 | 4/1998 | WIPO . |
| 98/14551 | 4/1998 | WIPO . |
| 98/14552 | 4/1998 | WIPO . |
| 98/14553 | 4/1998 | WIPO . |
| 98/14554 | 4/1998 | WIPO . |
| 98/14555 | 4/1998 | WIPO . |
| 98/14556 | 4/1998 | WIPO . |
| 98/14557 | 4/1998 | WIPO . |
| 98/14558 | 4/1998 | WIPO . |
| 98/58046 | 12/1998 | WIPO . |
| 98/58047 | 12/1998 | WIPO . |
| 98/58048 | 12/1998 | WIPO . |
| 99/00475 | 1/1999 | WIPO . |
| 99/03964 | 1/1999 | WIPO . |
| 99/03966 | 1/1999 | WIPO . |
| 99/03967 | 1/1999 | WIPO . |

OTHER PUBLICATIONS

International Search Report in the application of PCT/EP 98/03667.

International Search Report in the application of PCT/EP 98/03668.

International Search Report in the European Patent Application PCT/EP 98/03670.

U.K. Search Report in the application of GB 9712580 dated Oct. 9, 1997.

Watano et al., "Scale–Up of Agitation Fluidized Bed Granulation I. Preliminary Experimental Approach for Optimization of Process Variables", Chem. Pharm. Bull., vol. 43 (No. 7), Parts I–IV, pp. 1212–1230, 1995.

Schaefer et al., "Control of Fluidized Bed Granulation", Arch. Pharm. Chemi. Sci., Ed. 5, pp. 51–60, 1977.

*Primary Examiner*—Mary Lynn Theisen
*Attorney, Agent, or Firm*—Rimma Mitelman

[57] ABSTRACT

A process of forming a granular detergent products, is effected in a gas fluidisation granulator. A fluidised particulate solid material is contacted with a spray of liquid binder. The excess velocity ($U_e$) of fluidisation gas relative to the mass or volume flux of the spray ($\dot{q}_{mliq}$ or $\dot{q}_{vliq}$) when determined at the normalised nozzle-to-bed distance ($D_0$) is set so that the flux number ($FN_m$ or $FN_v$) as determined by $$FN_m = \log_{10}\left[\frac{\rho_p U_e}{\dot{q}_{mliq}}\right] \text{ OR } FN_v = \log_{10}\left[\frac{U_e}{\dot{q}_{vliq}}\right]$$

(where $\rho_p$ is the particle density) is at a critical value of at least 2 for at least 30% of the process.

20 Claims, No Drawings

PRODUCTION OF DETERGENT GRANULATES

The present invention relates to a process for the production of granular detergent compositions.

It is long known in the art to obtain detergent powders by spray drying. However, the spray-drying process is both capital and energy intensive and consequently the resultant product is expensive.

More recently, there has been much interest in production of granular detergent products by processes which employ mainly mixing, without the use of spray drying. These mixing techniques can offer great flexibility in producing powders of various different compositions from a single plant by post-dosing various components after an initial granulation stage.

A known kind of mixing process, which does not involve spray drying, employs a moderate-speed granulator (a common example often colloquially being called a "ploughshare"), optionally preceded by a high-speed mixer (a common example often colloquially being called a "recycler" due to its recycling cooling system). Typical examples of such processes are described in our European patent specifications EP-A-367 339, EP-A-390 251 and EP-A-420 317. These moderate-speed and high-speed mixers exert relatively high levels of shear on the materials being processed.

An alternative kind of mixer is a low-shear mixer or granulator, one particular example being a granulator of the gas fluidisation kind. In this kind of apparatus, a gas (usually air) is blown through a body of particulate solids onto which is sprayed a liquid component. A gas fluidisation granulator is sometimes called a "fluidised bed" granulator or mixer. However, this is not strictly accurate since such granulators can be operated with a gas flow rate so high that a classical fluid bed does not form.

Although gas fluidisation granulators can give good control of bulk density, there is still a need for greater flexibility and, in particular, for producing lower bulk density powders.

Processes involving gas fluidisation granulation are quite varied. For example, WO96/04359 (Unilever) discloses a process whereby low bulk density powders are prepared by contacting a neutralising agent such as an alkaline detergency builder and a liquid acid precursor of an anionic surfactant in a fluidisation zone to form detergent granules.

East German Patent No. 140 987 (VEB Waschmittelwerk) discloses a continuous process for the production of granular washing and cleaning compositions, wherein liquid nonionic surfactants or the acid precursors of anionic surfactants are sprayed onto a fluidised powdered builder material, especially sodium tripolyphosphate (STPP) having a high phase II content to obtain a product with bulk density ranging from 530–580 g/l.

The gas fluidisation granulation apparatus basically comprises a chamber in which a stream of gas, usually air, is used to cause turbulent flow of particulate solids to form a "cloud" of the solids and liquid binder is sprayed onto or into the cloud to contact the individual particles. As the process progresses, individual particles of solid starting materials become agglomerated, due to the liquid binder, to form granules.

Watano et al. (Chem. Pharm. Bull., 1995, Vol. 43 (no. 7), Parts I–IV, pp. 1212–1230) describe a series of studies concerning granulation scale-up in a fluidised bed apparatus. The effects of scale on various granule properties of a pharmaceutical formulation were tested for a number of processing factors including spray conditions, drying efficiency, air flow velocity, agitator rotational speed and blade angle and powder feed weight. All the studies related to an agitated fluidised bed system.

Schaefer & Worts (Arch. Pharm. Chemi. Sci., 1977, Ed. 5, pp. 51–60) describe the effects of spray angle, nozzle height and starting materials on granule size and distribution.

None of the prior art teaches how the control of process variables, and in particular the liquid spray and fluidising gas, relative to each other in a gas fluidisation granulation system affects the properties of a granulate.

Although gas fluidisation granulators are good at granulating detergent-type products, it is very difficult to produce granulates over a range of desired bulk densities, having an idealised particle size distribution and having good flow properties.

It has now been found that this is achievable by controlling the movement of fluidised solids, which is a function of the rate of flow of gas used to produce their fluidisation, relative to the rate of application of the liquid binder. In particular, the present invention is based on the finding that the aforementioned objects can be achieved by controlling the ratio of the product of the excess velocity ($U_e$) of the fluidisation gas and the particle density ($\rho_p$) relative to the mass flux ($\dot{q}_{mliq}$) of the liquid as determined at a normalised distance ($D_0$) of the liquid distribution (spray droplet producing) device.

In order to express this ratio as a simple positive number, the applicants have found it convenient to denote the aforementioned ratio as the "flux number" ($FN_m$) which is expressed as:

$$FN_m = \log_{10}\left[\frac{\rho_p U_e}{\dot{q}_{mliq}}\right]$$

According to the present invention, the spray mass flux ($\dot{q}_{mliq}$) at $D_0$ and the excess velocity ($U_e$) and the particle density ($\rho_p$) must be set such that FN is at a critical value of at least 2, for a major proportion of the process.

$FN_m$ is a dimensionless number, as is the quantity $\rho_p U_e/\dot{q}_{mliq}$ itself. All measurements used in calculating this number are in the units:

mass–kg velocity–$ms^{-1}$ time–s area–$m^2$ vol–$m^3$

The particle density ($\rho_p$) can be determined as follows:

The particulate solids are placed in a hopper situated 20 cm above a rectangular box of 300 ml internal volume. The hopper is fitted with a horizontal metal slide so that the hopper can be filled before the solids are allowed to fall into the box. The slide is then lifted and allowed to fill the box beyond capacity (i.e. to overflow). The surface of solids in the box is levelled by careful scraping-away the excess with the metal slide at right angles to the surface of the solids and to the rim of the box, without exerting any compression action. Then, the solids in the box are weighed. The weighed mass is divided by the internal volume of the box to give the bulk density (BD) of the powder. Then:

$$\rho_p = \frac{BD}{1-\varepsilon_{bed}}$$

where $\epsilon_{bed}$ is the bed porosity (not the particle porosity).

The value of $\epsilon_{bed}$ is determined by mercury porosimetry. As mentioned elsewhere in this specification, mercury porosimetry is unsuitable for determining the porosity of small particles but it is suitable for determining a bed porosity. The methodology for determining $\epsilon_{bed}$ by the mercury technique is described in various standard texts.

The liquid mass flux ($\dot{q}_{mliq}$) can be determined from:

$$\dot{q}_{mliq} = \frac{Q_{mliq}}{A}$$

where $Q_{mliq}$ represents the mass flow of liquid applied per contact unit area (A) measured at the normalised nozzle-to-bed distance $D_0$. To determine $D_0$ it is first necessary to measure the height ($H_N$) of the spray "nozzle" above the bottom of the fluidisation chamber and to determine the bed height ($H_{bed}$) under the process operating conditions. In the case of a fluidised bed apparatus per se, this height $H_N$ is the height of the nozzle above the bottom of the distribution plate that separates the fluidisation chamber and the gas distribution chamber. The quantity $H_{bed}$ is a parameter determined by the solids. Of course the spray may not be produced by a nozzle per se but for the present purposes, the term "nozzle" is used to refer to the piece of the apparatus from which the spray droplets finally emanate before encountering the solids.

If the liquid is applied as a spray from discrete nozzles then the contact area (A) can be taken as the "footprint" area for each cone of spray at the calculated $H_{bed}$, for each nozzle. If a general "mist" spray is used to wet the entire area of the fluidisation chamber (at $H_{bed}$) then the total mass flow applied over that entire area can be determined. It should be noted that it is very much preferred that the spray should not significantly wet the interior walls of the fluidisation chamber, so that little or no liquid should run down the inside of these walls.

The value of $U_e$, which is also necessary to calculate $FN_m$ is given by:

$$U_e = U_s - U_{mf}$$

The "superficial velocity" ($U_s$) is measured as the gas velocity at a given gas supply rate, without the solids present in the fluidisation chamber. Preferably, $U_s$ is determined at the position in the fluidisation chamber corresponding to the bed height ($H_{bed}$).

The gas velocity at minimum fluidisation is measured as the minimum fluidisation velocity ($U_{mf}$), as is the height of the bed at minimum fluidisation ($H_{mf}$). This can be done by adding solids to a fluidisation chamber, which is not necessarily that of the granulator, the gas flow initially being switched off. Then, the gas flow is gradually increased until fluidisation just occurs. This is minimum fluidisation.

It should be noted that in the actual process according to the present invention, the degree of turbulence in the cloud of fluidised solids will be so high that no discernible "bed" will be formed. However, that does not detract from the validity of determining a bed height ($H_{bed}$) for the high gas flow rates used for such turbulent operation. In those cases where a discernible bed is apparent, then $H_{bed}$ can of course be measured directly. In all other cases (where turbulence inhibits formation of an observable bed), the bed height can be calculated from the conventional equation:

$$H_{bed} = H_{mf} \times \frac{1}{1-\varepsilon_{bubble}}$$

where $\epsilon_{bubble}$ is a term allowing for the volume fraction of bubble formation and determined according to standard texts on fluid beds.

However, to a very good approximation, when there is no discernible bed formed, $H_{bed}$ can be calculated from:

$$H_{bed} = 1.67 \times H_{mf}$$

Then, $D_0 = H_N - H_{bed}$ with the proviso that if $D_0$ is 15 cm or less, then $D_0$ is taken as 15 cm for purposes of determining the contact area (A). This is because for practical purposes, it has been found that the mean penetration of the spray for a nozzle situated below or within the cloud of solids is about 15 cm.

A nozzle situated within or below the cloud of solids may not necessarily project the spray vertically upwards or downwards, but could also project it in any other direction. The contact area (A) is the area measured at a distance $D_0$ from the nozzle. The nozzle is removed from the granulator and oriented so as to point downwardly at a height $D_0$ above a plane wherein the wetted area (A) is determined regardless of the projection in the process itself. The contact area is the contact area wetted by the spray in a plane situated at $D_0$ below the nozzle. However, in many cases the majority of the spray may be concentrated over a certain area with a penumbra wherein the degree of wetting is less. The penumbra is disregarded and the area A is determined as the area where 90% of the mass (or volume, as appropriate: see below) of the liquid falls. In any event, it is very much preferred that the nozzle should be such that the droplets of spray (at least within the aforementioned 90% wetted area) are substantially homogeneously distributed.

Finally, the process of the present invention requires $FN_m$ to be at least 2 for 30% of the process. Thus, a first aspect of the present invention now provides a process of forming a granular detergent product, the process comprising, in a gas fluidisation granulator, contacting a fluidised particulate solid material with a spray of liquid binder, such that the product of the particle density ($\rho_p$) and the excess velocity ($U_e$) of fluidisation gas relative to the mass flux of the spray ($\dot{q}_{mliq}$) when determined at the normalised nozzle-to-bed distance ($D_0$) is set so that the flux number ($FN_m$) as determined by:

$$FN_m = \log_{10}\left[\frac{\rho_p U_e}{\dot{q}_{mliq}}\right]$$

is at a critical value of at least 2 for at least 30% of the process.

Actually, it should be noted that a very good approximation of $FN_m$ can be obtained by omitting the determination of $\rho_p$ and utilising the volume flux ($\dot{q}_{vliq}$) instead of the mass flux ($\dot{q}_{mliq}$). Then:

$$\dot{q}_{vliq} = \frac{Q_{mliq}}{\rho_{liq} A}$$

where $\rho_{liq}$ is the density of the liquid binder and A is the contact unit area (determined as hereinbefore described). In this case:

$$FN_v = \log_{10}\left[\frac{U_e}{\dot{q}_{vliq}}\right]$$

Therefore, a second aspect of the present invention provides a process of forming a granulator detergent product, the process comprising, in a gas fluidisation granulator, contacting a fluidised particulate solid material with a spray of liquid binder, such that the excess velocity ($U_e$) of fluidisation gas relative to the volume flux at the spray ($\dot{q}_{vliq}$) is set so that the flux number ($FN_v$) as determined by:

$$FN_v = \log_{10}\left[\frac{U_e}{\dot{q}_{vliq}}\right]$$

is at a critical value of 2 for at least 30% the process.

The gas fluidisation granulator is typically operated at a superficial air velocity ($U_s$) of about 0.1–1.2 $ms^{-1}$, either under positive or negative relative pressure and with an air inlet temperature ranging from −10° or 5° C. up to 80° C., or in some cases, up to 200° C. An internal operational temperature of from ambient temperature to 60° C. is typical. Preferably $U_s$ is at least 0.45 and more preferably at least 0.5 $ms^{-1}$. Preferably, $U_s$ is in the range 0.8–1.2 $ms^{-1}$.

It is preferred that the mass flux of the spray ($\dot{q}_{mliq}$) is at least 0.1 and more preferably at least 0.15 $kgs^{-1}m^{-2}$. Preferably, the mass flux of the spray is in the range 0.20–1.5 $kgs^{-1}m^{-2}$.

If the process is a batch process, then FN must be at least 2 for at least 30% of the processing time (reference to FN means $FN_m$ or $FN_v$, as appropriate). If the process is a continuous process, FN must be at least 2 for at least 30% of the area of the bed over which the spraying is carried out. Thus, FN refers not only to any solids put into the granulator at the beginning of the process but also solids added part-way through the process. To determine FN during part-way through the process, it is therefore necessary to remove a sample of solids at that time or position (according to whether it is, respectively, a batch or a continuous process) and perform the determination of $U_{mf}$, $\rho_p$ and $H_{bed}$ in a separate chamber. The "process" in this context is to be taken as the time or area of the process which occurs only while liquid is being sprayed and excludes any part of the process where spraying is not being performed.

The particulate solids on the basis of which FN is determined could be discrete powdered particles of one or more raw material put in at the beginning. However, part-way through the process, the solids used to determine FN will inevitably be at least partially granular. Moreover, as will be described in more detail hereinbelow, even particulate material put in at the start of the fluidisation/spraying process could be already at least partially granular.

Although the critical value FN must be maintained for at least 30% of the process, preferably it is maintained for at least 50% or 70%, more preferably at least 75%, still more preferably at least 80%, yet more preferably at least 85%, most preferably at least 90% and especially, at least 95% of the process. In the most idealised case, this critical value is maintained for substantially the whole of the process.

Moreover, whatever the percentage of the process over which the critical value of FN (whether 2 or higher) is maintained, it is preferred that FN is actually at least 2.3, more preferably at least 2.5, still more preferably at least 2.6 and most preferably at least 3. At higher values of FN, processing times/lengths become very long and eventually, the process becomes economically unviable, even though the products thus produced are very good indeed. Thus, from the quality point of view, FN should be as high as possible but for economic reasons, FN is preferably no higher than 6, more preferably no higher than 5 and most preferably, no higher than 4.5.

In the context of the present invention, the term "granular detergent product" encompasses granular finished products for sale, as well as granular components or adjuncts for forming finished products, e.g. by post-dosing to or with, or any other form of admixture with further components or adjuncts. Thus a granular detergent product as herein defined may, or may not contain detergent material such as synthetic surfactant and/or soap. The minimum requirement is that it should contain at least one material of a general kind of conventional component of granular detergent products, such as a surfactant (including soap), a builder, a bleach or bleach-system component, an enzyme, an enzyme stabiliser or a component of an enzyme stabilising system, a soil anti-redeposition agent, a fluorescer or optical brightener, an anti-corrosion agent, an anti-foam material, a perfume or a colourant.

As used herein, the term "powder" refers to materials substantially consisting of grains of individual materials and mixtures of such grains. The term "granule" refers to a small particle of agglomerated powder materials. The final product of the process according to the present invention consists of, or comprises a high percentage of granules. However, additional granular and or powder materials may optionally be post-dosed to such a product.

The solid starting materials of the present invention are particulate and may be powdered and/or granular.

All references herein to the $d_{3,2}$ average of solid starting materials refers to the $d_{3,2}$ average diameter only of solids immediately before they are added to the gas fluidisation granulation process. For example, hereinbelow it is described how the gas fluidisation granulator may be fed by at least partially pre-granulated solids from a pre-mixer. It is very important to note that "solid starting material" is to be construed as including all the material from the pre-mixer which is fed to the gas fluidisation granulation process but does not include all solids as dosed to the pre-mixer and/or direct to any other processing stage up to processing or after the end of processing in the gas fluidisation granulator. For example, a layering agent or flow aid added after the granulation process in the fluidisation granulator does not constitute a solid starting material.

Whether the gas fluidisation granulation process of the present invention is a batch process or a continuous process, solid starting material may be introduced at any time during the time when liquid binder is being sprayed. In the simplest form of process, solid starting material is first introduced to the gas fluidisation granulator and then sprayed with the liquid binder. However, some solid starting material could be introduced at the beginning of processing in the gas fluidisation apparatus and the remainder introduced at one or more later times, either as one or more discrete batches or in continuous fashion. However, all such solids fall within the definition of "solid starting material".

The $d_{3,2}$ diameter of the solid starting materials is that obtained by conventional laser diffraction technique (e.g. using a Helos Sympatec instrument).

Suitably, the solid starting material(s) have a particle size distribution such that not more than 5% by weight of the particles have a particle size greater than 250 $\mu$m. It is also preferred that at least 30% by weight of the particles have a particle size below 100 $\mu$m, more preferably below 75 $\mu$m. However the present invention is also usable with larger fractions of solid starting materials (i.e. >5% more than 250 μm, optionally also <30% below 100 μm or 75 μm) but this increases the chance of some crystals of unagglommerated starting materials being found in the final product. This presents a cost benefit in allowing use of cheaper raw materials. In any event, the solid starting material(s) have an average particle size below 500 μm to provide detergent powders having a particularly desired low bulk density. Within the context of solid starting materials, reference to an average particle size means the $d_{3,2}$ average particle diameter.

Preferably, the $d_{3,2}$ average droplet diameter of the liquid binder is not greater than 10 times, preferably not greater than 5 times, more preferably not greater than 2 times and most preferably not greater than the $d_{3,2}$ average particle diameter of that fraction of the total solid starting material which has a $d_{3,2}$ particle diameter of from 20 μm to 200 μm, provided that if more than 90% by weight of the solid starting material has a $d_{3,2}$ average particle diameter less than 20 μm then the $d_{3,2}$ average particle diameter of the total solid starting material shall be taken to be 20 μm and if more than 90% by weight of the solid starting material has a $d_{3,2}$ average particle diameter greater than 200 μm then the $d_{3,2}$ average particle diameter of the total solid starting material shall be taken to be 200 μm.

In practice, the nozzle chosen to achieve a given droplet size, when used in accordance with the instructions of the manufacturer of the gas fluidisation granulator will predetermine the liquid application rate and hence the degree of wetting in the wetted area (A). Therefore, a third aspect of the present invention provides a process of forming a granular detergent product, the process comprising, in a gas fluidisation granulator, contacting a fluidised particulate solid material with a spray of liquid binder, such that for at least 30% of the process:

(a) the excess gas velocity ($U_e$) is from 0.1 to 1.0 $ms^{-1}$ preferably from 0.3 to 0.9 $ms^{-1}$, more preferably from 0.4 to 0.6 $ms^{-1}$;

(b) the $d_{3,2}$ average droplet diameter of the liquid binder is from 20 μm to 200 μm; and (c) the $d_{3,2}$ average droplet diameter of the liquid binder is not greater than 10 times, preferably not greater than 5 times, more preferably not greater than 2 times and most preferably not greater than the $d_{3,2}$ average particle diameter of that fraction of the total solid starting material which has $d_{3,2}$ a particle diameter of from 20 μm to 200 μm, provided that if more than 90% by weight of the solid starting material has a $d_{3,2}$ average particle diameter less than 20 μm then the $d_{3,2}$ average particle diameter of the total solid starting material shall be taken to be 20 μm and if more than 90% by weight of the solid starting material has a $d_{3,2}$ average particle diameter greater than 200 μm then the $d_{3,2}$ average particle diameter of the total solid starting material shall be taken to be 200 μm.

The values (a) to (c) of the third aspect of the invention are maintained for at least 30% of the process but preferably for any of the preferred, more preferred etc. percentages specified for maintenance of the critical value of FN for the first and/or second aspects of the present invention. Similarly, these percentages are to be understood as referring to percentages of contacting time (for a batch process) or contacting area (for a continuous process).

The maximum $d_{3,2}$ average droplet diameter is preferably 200 μm, for example 150 μm, more preferably 120 μm, still more preferably 100 μm and most preferably 80 μm. On the other hand, the minimum $d_{3,2}$ droplet diameter is 20 μm, more preferably 30 μm and most preferably 40 μm. It should be noted that in specifying any particular preferred range herein, no particular maximum $d_{3,2}$ average droplet diameter is associated with any particular minimum $d_{3,2}$ average droplet diameter. Thus, for example, a preferred range would be constituted by 150–20 μm, 150–30 μm, 150–40 μm, 120–20 μm, 120–30 μm . . . and so on.

The $d_{3,2}$ average droplet diameter is suitably measured, for example, using a laser phase doppler anemometer or a laser light-scattering instrument (e.g. as supplied by Malvern or Sympatec) as would be well-know to the skilled person. The gas fluidisation granulator may be adapted to recycle "fines" i.e. powdered or part-granular material of very small particle size, so that they are returned to the input of the gas fluidisation apparatus and/or of any pre-mixer. Such recycled fines may actually be returned to the input or any stage of the process, but especially towards the latter part of the processing in the gas fluidisation granulator to act as a flow aid or layering agent. This is discussed further hereinbelow.

Thus, a fourth aspect of the present invention now provides a process of forming a granular detergent product, the process comprising, in a gas fluidisation granulator, contacting a fluidised particulate solid material with a spray of liquid binder, extracting fine particulates during granulation and re-introducing the fine particulates to the process to act as a flow aid or layering agent.

Preferably the fine particulates are elutriated material, e.g. they are present in the air leaving the gas fluidisation chamber. These fines are preferably recycled during operation of a continuous gas fluidisation granulation process but it can also be done in batch mode. They may optionally be stored prior to re-introduction.

The gas fluidisation granulator may optionally be of the kind provided with a vibrating bed, particularly for use in continuous mode. In the case of a vibrating bed, the height $H_N$ is measured as the distance of the nozzle above the bottom of the distribution plate when the distribution plate is not vibrating.

The equations of the present invention are particularly applicable to gas fluidisation granulators which do not have a rotational and/or mechanical agitator.

In a preferred class of processes according to the present invention, the liquid binder comprises an acid precursor of an anionic surfactant and the fluidising particulate solids comprises an inorganic alkaline material.

Such an acid precursor may for example be the acid precursor of a linear alkylbenzene sulphonate (LAS) or primary alkyl sulphate (PAS) anionic surfactant or of any other kind of anionic surfactant.

Suitable materials for use as the inorganic alkaline material include alkali metal carbonates and bicarbonates, for example sodium salts thereof.

The neutralising agent is very preferably present at a level sufficient to neutralise fully the acidic component. If desired, a stoichiometric excess of neutralising agent may be employed to ensure complete neutralisation or to provide an alternative function, for example as a detergency builder, e.g. if the neutralising agent comprises sodium carbonate.

The liquid binder may alternatively or additionally contain one or more other liquid materials such as liquid nonionic surfactants and/or organic solvents. The total amount of acid precursor will normally be as high as possible, subject to the presence of any other components in the liquid and subject to other considerations referred to below. Thus, the acid precursor may constitute at least 98% (e.g. at least 95%) by weight of the liquid binder, but could be at least 75%, at least 50% or at least 25% by weight of the binder. It can even, for example, constitute 5% or less by weight of the binder. Of course the acid precursor can be omitted altogether if required.

When liquid nonionic surfactant is present in the liquid binder together with an acid precursor of an anionic surfactant, then the weight ratio of all acid precursor(s) to nonionic surfactants, will normally be from 20:1 to 1:20. However, this ratio may be, for example, 15:1 or less (of the anionic), 10:1 or less, or 5:1 or less. On the other hand, the nonionic may be the major component so that the ratio is 1:5 or more (of the nonionic), 1:10 or more, or 1:15 or more. Ratios in the range from 5:1 to 1:5 are also possible.

For manufacture of granules containing anionic surfactant, sometimes it will be desirable not to incorporate all of such anionic by neutralisation of an acid precursor. Some can optionally be incorporated in the alkali metal salt form, dissolved in the liquid binder or else as part of the solids. In that case, the maximum amount of anionic incorporated in the salt form (expressed as the weight percentage of total anionic surfactant salt in the product output from the gas fluidisation granulator) is preferably no more than 70%, more preferably no more than 50% and most preferably no more than 40%.

If it is desired to incorporate a soap in the granules, this can be achieved by incorporating a fatty acid, either in solution in the liquid binder or as part of the solids. The solids in any event must then also comprise an inorganic alkaline neutralising agent to react with the fatty acid to produce the soap.

The liquid binder will often be totally or substantially non-aqueous, that is to say, any water present does not exceed 25% by weight of the liquid binder, but preferably no more than 10% by weight. However, if desired, a controlled amount of water may be added to facilitate neutralisation. Typically, the water may be added in amounts of 0.5 to 2% by weight of the detergent product. Any such water is suitably added prior to or together or alternating with the addition of the acid precursor.

Alternatively, an aqueous liquid binder may be employed. This is especially suited to manufacture of products which are adjuncts for subsequent admixture with other components to form a fully formulated detergent product. Such adjuncts will usually, apart from components resulting from the liquid binder, mainly consist of one, or a small number of components normally found in detergent compositions, e.g. a surfactant or a builder such as zeolite or sodium tripolyphosphate. However, this does not preclude use of aqueous liquid binders for granulation if substantially fully formulated products. In any event, typical aqueous liquid binders include aqueous solutions of alkali metal silicates, water soluble acrylic/maleic polymers (e.g. Sokalan CP5) and the like.

In a refinement of the process of the present invention, a solid starting material may be contacted and mixed with a first portion of the liquid binder, e.g. in a low-, moderate- or high-shear mixer (i.e. a pre-mixer) to form a partially granulated material. The latter can then be sprayed with a second portion of the liquid binder in the gas fluidisation granulator, to form the granulated detergent product.

In such a two-stage granulation process, it is preferred, but not absolutely necessary, for the total of liquid binder to be dosed only in the partial granulation pre-mixer and fluidisation steps. Conceivably, some could be dosed during or before partial granulation premixing and/or fluidisation. Also, the content of the liquid binder could be varied between these first and second stages.

The extent of granulation in the pre-mixer (i.e. partial granulation) and the amount of granulation in the gas fluidisation granulator is preferably determined in accordance with the final product density desired. Preferred amounts of liquid binder to dosed at each of the two stages may be varied thus:

(i) If a lower powder density is desired, i.e. 350–650 g/l
  (a) 5–75% by weight of total liquid binder is preferably added in the pre-mixer; and
  (b) the remaining 95–25% by weight of total liquid binder is preferably added in the gas fluidisation granulator.

(ii) If a higher powder density is desired, i.e. 550–1300 g/l
  (a) 75–95% by weight of total liquid binder is preferably added in the pre-mixer; and
  (b) the remaining 25–5% by weight of total liquid binder is preferably added in the gas fluidisation granulator.

If an initial pre-mixer is used for partial granulation, an appropriate mixer for this step is a high-shear Lodige$^R$ CB machine or a moderate-speed mixer such as a Lodige$^R$ KM machine. Other suitable equipment include Drais$^R$ T160 series manufactured by Drais Werke GmbH, Germany; the Littleford mixer with internal chopping blades and turbine-type miller mixer having several blades on an axis of rotation. A low-or high-shear mixer granulator has a stirring action and/or a cutting action which are operated independently of one another. Preferred types of low- or high-shear mixer/granulators are mixers of the Fukae$^R$ FS-G series; Diosna$^R$ V series ex Dierks & Sohne, Germany; Pharma Matrix$^R$ ex T.K. Fielder Ltd; England. Other mixers believed to be suitable for use in the process of the invention are Fuji$^R$ VG-C series ex Fuji Sangyo Co., Japan; the Roto$^R$ ex Zanchetta & Co. srl, Italy and Schugi$^R$ Flexomix granulator.

Yet another mixer suitable for use in a pre-granulation stage is the Lodige (Trade Mark) FM series (ploughshare mixers) batch mixer ex Morton Machine Co. Ltd., Scotland.

Optionally, a "layering agent" or "flow aid" may be introduced at any appropriate stage. This is to improve the granularity of the product, e.g. by preventing aggregation and/or caking of the granules. Any layering agent/flow aid is suitably present in an amount of 0.1 to 15% by weight of the granular product and more preferably in an amount of 0.5 to 5%. The layering agent/flow aid, may be in the form of recirculated fines, in accordance with the fourth aspect of the present invention.

Suitable layering agents/flow aids (whether or not introduced by recirculation) include crystalline or amorphous alkali metal silicates, aluminosilicates including zeolites, Dicamol, calcite, diatomaceous earths, silica, for example precipitated silica, chlorides such as sodium chloride, sulphates such as magnesium sulphate, carbonates such as calcium carbonate and phosphates such as sodium tripolyphospate. Mixtures of these materials may be employed as desired.

In general, additional components may be included in the liquid binder or admixed with the solid neutralising agent at an appropriate stage of the process. However, solid components can be post-dosed to the granular detergent product.

In addition to any anionic surfactant which optionally may be produced by a neutralisation step, further anionic surfactants, or nonionic surfactant as mentioned above, also, cationic, zwitterionic, amphoteric or semipolar surfactants and mixtures thereof may be added at a suitable time. In general suitable surfactants include those generally described in "Surface active agents and detergents", Vol I by Schwartz and Perry. As mentioned above if desired, soap derived from saturated or unsaturated fatty acids having, for example having an average of $C_{10}$ to $C_{18}$ carbon atoms may also be present.

If present, the detergent active is suitably incorporated at a level of 5 to 40%, preferably 10 to 30% by weight of the final granular detergent product.

A complete detergent composition often contains a detergency builder. Such a builder may be introduced with the solid material and/or added subsequently as desired. The builder may also constitute a neutralising agent, for example sodium carbonate, in which case sufficient material will be employed for both functions.

Generally speaking, the total amount of detergency builder in the granular product is suitably from 5 to 95%, preferably 10 to 80%, more preferably from 15 to 65%, especially from 15 to 50% by weight.

Inorganic builders that may be present include sodium carbonate, if desired in combination with a crystallisation seed for calcium carbonate as disclosed in GB-A-1 437 950. Any sodium carbonate will need to be in excess of any used to neutralise the anionic acid precursor if the latter is added during the process.

Other suitable builders include crystalline and amorphous aluminosilicates, for example zeolites as disclosed in GB-A-1 473 201; amorphous aluminosilicates as disclosed in GB-A-1 473 202; and mixed crystalline/amorphous aluminosilicates as disclosed in GB 1 470 250; and layered silicates as disclosed in EP-B-164 514. Inorganic phosphate builders, for example, sodium, orthophosphate, pyrophosphate and tripolyphosphate, may also be present, but on environmental grounds those are no longer preferred.

Aluminosilicates, whether used as layering agents and/or incorporated in the bulk of the particles may suitably be present in a total amount of from 10 to 60% and preferably an amount of from 15 to 50% by weight. The zeolite used in most commercial particulate detergent compositions is zeolite A. Advantageously, however, maximum aluminium zeolite P (zeolite MAP) described and claimed in EP-A-384 070 may be used. Zeolite MAP is an alkali metal aluminosilicated of the P type having a silicon to aluminium ratio not exceeding 1.33, preferably not exceeding 1.15, and more preferably not exceeding 1.07.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts. A copolymer of maleic acid, acrylic acid and vinyl acetate is especially preferred as it is biodegradable and thus environmentally desirable. This list is not intended to be exhaustive.

Especially preferred organic builders are citrates, suitably used in amounts of from 5 to 30%, preferably from 10 to 25% by weight; and acrylic polymers, more especially acrylic/maleic copolymers, suitably used in amounts of from 0.5 to 15%, preferably from 1 to 10% by weight. Citrates can also be used at lower levels (e.g. 0.1 to 5% by weight) for other purposes. The builder is preferably present in alkali metal salt, especially sodium salt, form.

Suitably, the builder system may also comprise a crystalline layered silicate, for example, SKS-6 ex Hoechst, a zeolite, for example, zeolite A and optionally an alkali metal citrate.

The granular composition resulting from the process of the present invention may also comprise a particulate filler (or any other component which does not contribute to the wash process) which suitably comprises an inorganic salt, for example sodium sulphate and sodium chloride. The filler may be present at a level of 5 to 70% by weight of the granular product.

The present invention also encompasses a granular detergent product resulting from the process of the invention (before any post-dosing or the like). This product will have a bulk density determined by the exact nature of the process. If the process does not involve a pre-mixer to effect partial granulation, a final bulk density of 350–750 g/l can normally be expected. As mentioned above, use of a pre-mixer enables the final bulk density to be 350–650 g/l or 550–1300 g/l, respectively, according to whether option (i) or (ii) is utilised. However, granular detergent products resulting from the present invention are also characterised by their particle size ranges. Preferably not more than 10% by weight has a diameter >1.4 mm and more preferably, not more than 5% by weight of the granules are above this limit. It is also preferred that not more than 20% by weight of the granules have a diameter >1 mm. Finally, the granules can be distinguished from granules produced by other methods by mercury porosimetry. The latter technique cannot reliably determine the porosity of individual unagglomerated particles but can be used for characterising the granules.

A fully formulated detergent composition produced according to the invention might for example comprise the detergent active and builder and optionally one or more of a flow aid, a filler and other minor ingredients such as colour, perfume, fluorescer, bleaches, enzymes.

The invention will now be illustrated by the following non-limiting examples.

EXAMPLES

The following formulation was produced:

| | |
|---|---|
| Sodium-LAS | 24 wt % |
| Sodium-Carbonate | 32 wt % |
| STPP | 32 wt % |
| Zeolite 4A | 10 wt % |
| Water | 2 wt % |

In examples I to IV, a Spraying Systems nozzle SUE 25 was used, operating at 5 bar atomising pressure, whilst in example V, the same nozzle was operated at 2.5 bar atomising pressure. In these examples, the rate of addition of the liquids to the solids was varied, between 0.50 and 1.60 $kgmin^{-1}$, as well as the fluidisation velocity, which was varied from 0.9 to 1.1 $ms^{-1}$.

In examples VI to VIII, a Spraying Systems nozzle VAU SUV 152 was used, where the rate of addition of the liquid to the solids was set at 2.0 $kgmin^{-1}$. The nozzle height above the distributor plate was varied between 0.50 and 0.80 m under these operating conditions.

The following values for the operating conditions and product properties have been obtained. The $FN_m$ number was calculated using the description given above.

| Example | | I | II | III | IV | V |
|---|---|---|---|---|---|---|
| Nozzle height | [cm] | 47 | 47 | 47 | 47 | 47 |

-continued

| | | | | | | |
|---|---|---|---|---|---|---|
| Liquid mass flow | [kgmin$^{-1}$] | 0.50 | 1.00 | 1.28 | 1.60 | 0.81 |
| Air flow | [ms$^{-1}$] | 1.1 | 1.1 | 1.1 | 1.1 | 0.9 |
| At the end of the process: | | | | | | |
| Bed height | [cm] | 34 | 34 | 34 | 34 | 34 |
| Nozzle distance | [cm] | 15 | 15 | 15 | 15 | 15 |
| Area wetted | [cm$^2$] | 329 | 329 | 329 | 329 | 329 |
| Umf | [ms$^{-1}$] | 0.07 | 0.09 | 0.16 | 0.17 | 0.18 |
| rho (part) | [kgm$^{-3}$] | 768 | 795 | 848 | 873 | 887 |
| FN | | 3.49 | 3.20 | 3.09 | 3.00 | 3.19 |
| Product quality: | | | | | | |
| Bulk density | [g/l] | 461 | 477 | 509 | 524 | 532 |
| RRd* | | 522 | 599 | 793 | 808 | 818 |
| Coarse fraction (>1400) | [wt %] | 0.2 | 0.5 | 9.6 | 13.7 | 7.4 |

| Example | | VI | VII | VIII |
|---|---|---|---|---|
| Nozzle height | [cm] | 50 | 70 | 80 |
| Liquid mass flow | [kgmin$^{-1}$] | 2.00 | 2.00 | 2.00 |
| Air flow | [ms$^{-1}$] | 0.8 | 0.8 | 0.8 |
| At the end of the process | | | | |
| Bed height | [cm] | 52 | 52 | 52 |
| Nozzle distance | [cm] | 15 | 18 | 28 |
| Area wetted | [cm$^2$] | 407 | 586 | 1420 |
| Umf | [ms$^{-1}$] | 0.22 | 0.12 | 0.07 |
| rho (part) | [kgm$^{-3}$] | 1013 | 907 | 833 |
| FN | | 2.86 | 3.04 | 3.41 |
| Product quality: | | | | |
| Bulk density | [g/l] | 606 | 544 | 500 |
| RRd* | | 865 | 644 | 513 |
| Coarse fraction (>1400) | [wt %] | 28.6 | 11.5 | 2.1 |

The n value of the Rosin Rammler distribution is calculated by fitting the particle size distribution to an n-power distribution according to the following formula:

$$R = 100 * \mathrm{Exp}\left\{-\left(\frac{D}{D_r}\right)^n\right\}$$

where R is the cumulative percentage of powder above a certain size D. $D_r$ is the average granule size (corresponding to RRd) and n is a measure of the particle size distribution. $D_r$ and n are the Rosin Rammler fits to a measured particle size distribution. A high n value means a narrow particle size distribution and low values mean a broad particle size distribution.

We claim:

1. A process of forming a granular detergent product, the process comprising, in a gas fluidisation granulator, contacting a fluidised particulate solid material with a spray of liquid binder, such that the product of the particle density ($\rho_p$) and the excess velocity ($U_e$) of fluidisation gas relative to the mass flux of the spray ($\dot{q}_{mliq}$) when determined at the normalised nozzle-to-bed distance ($D_0$) is set so that the flux number ($FN_m$) as determined by $$FN_m = \log_{10}\left[\frac{\rho_p U_e}{\dot{q}_{mliq}}\right]$$

is at a critical value of at least 2 for at least 30% of the process.

2. A process of forming a granulator detergent product, the process comprising, in a gas fluidisation granulator, contacting a fluidised particulate solid material with a spray of liquid binder, such that the excess velocity ($U_e$) of fluidisation gas relative to the volume flux of the spray ($\dot{q}_{vliq}$) is set so that the flux number ($FN_v$) as determined by $$FN_v = \log_{10}\left[\frac{U_e}{\dot{q}_{vliq}}\right]$$

is at a critical value of at least 2 for at least 30% the process.

3. A process according to claim 1, wherein the mass flux of the spray ($\dot{q}_{mliq}$) is at least 0.1.

4. A process according to claim 1, wherein the the superficial air velocity ($U_s$) is at least 0.45.

5. A process according to claim 1, wherein the process is a batch process and the critical value of FN is maintained for at least 30% of the contacting time.

6. A process according to claim 1, wherein the process is a continuous process and the critical value FN is maintained at for least 30% of the contacting area.

7. A process according to claim 1, wherein the critical value of FN is maintained for at least 50% or 70% of the process.

8. A process according to claim 1, wherein the critical value of FN is at least 2.3.

9. A process according to claim 1, wherein the critical value of FN is no more than 6.

10. A process according to claim 1, wherein the $d_{3,2}$ average droplet diameter of the liquid binder is not greater than 10 times the $d_{3,2}$ average particle diameter of that fraction of the total solid starting material which has a particle diameter of from 20 $\mu$m to 200 $\mu$m provided that if more than 90% by weight of the solid starting material has a $d_{3,2}$ average particle diameter less than 20 $\mu$m then the $d_{3,2}$ average particle diameter of the total solid starting material shall be taken to be 20 $\mu$m and if more than 90% by weight of the solid starting material has a $d_{3,2}$ average particle diameter greater than 200 $\mu$m then the $d_{3,2}$ average particle diameter of the total solid starting material shall be taken to be 200 $\mu$m.

11. A process according to claim 1, wherein minimum $d_{3,2}$ average droplet diameter is 20 $\mu$m.

12. A process according to claim 1, wherein the maximum $d_{3,2}$ average droplet diameter is 200 $\mu$m.

13. A process of forming a granular detergent product, the process comprising, in a gas fluidisation granulator, contacting a fluidised particulate solid material with a spray of liquid binder, such that for at least 30% of the process:

(a) the excess gas velocity ($U_e$) is from 0.1 to 1.0 ms$^{-1}$ preferably from 0.3 to 0.9 ms$^{-1}$ more preferably from 0.4 to 0.6 ms$^{-1}$;

(b) the $d_{3,2}$ average droplet diameter of the liquid binder is from 20 $\mu$m to 200 $\mu$m; and (c) the $d_{3,2}$ average droplet diameter of the liquid binder is not greater than 10 times the $d_{3,2}$ average particle diameter of that fraction of the total solid starting material which has $d_{3,2}$ a particle diameter of from 20 $\mu$m to 200 $\mu$m, provided that if more than 90% by weight of the solid starting material has a $d_{3,2}$ average particle diameter less than 20 $\mu$m then the $d_{3,2}$ average particle diameter of the total solid starting material shall be taken to be 20 $\mu$m and if more than 90% by weight of the solid starting material has a $d_{3,2}$ average particle diameter greater than 200 $\mu$m then the $d_{3,2}$ average particle diameter of the total solid starting material shall be taken to be 200 $\mu$m.

14. A process according to claim 13, wherein conditions (a), (b) and (c) are maintained for at least 50% or 70% of the process.

15. A process of forming a granular detergent product, the process comprising, in a gas fluidisation granulator, contacting a fluidised particulate solid material with a spray of liquid binder, extracting fine particulates during granulation and re-introducing the fine particulates to the process to act as a flow aid or layering agent.

16. A process according to claim 15, wherein at least some of the fine particulates are re-introduced at least at one time during at least the latter half of the gas fluidisation granulation process.

17. A process according to claim 1, wherein the liquid binder comprises an acid precursor of an anionic surfactant and the particulate solids comprise an inorganic alkaline material.

18. A process according to claim 1, wherein a first portion of the liquid binder is admixed with a particulate solid starting material in a pre-mixer to form a partially granular solid material and then a second portion of the liquid binder is sprayed to contact the partially granular solid material in the gas fluidisation granulator to effect complete granulation.

19. A process according to claim 18, wherein the granular detergent product has a bulk density of from 350 to 650 g/l, wherein:

(a) 5–75% by weight of total liquid binder is added in the pre-mixer; and (b) the remaining 95–25% by weight of total liquid binder is added in the gas fluidisation granulator.

20. A process according to claim 18, wherein the granular detergent product has a bulk density of from 550 to 1300 g/l, wherein:

(a) 75–95% by weight of total liquid binder is added in the pre-mixer; and (b) the remaining 25–5% by weight of total liquid binder is added in the gas fluidisation granulator.

* * * * *